US010893369B2

(12) United States Patent
Fung et al.

(10) Patent No.: US 10,893,369 B2
(45) Date of Patent: Jan. 12, 2021

(54) CONTROLLED FITTING OF AN IMPLANTABLE MEDICAL DEVICE

(71) Applicant: COCHLEAR LIMITED, Macquarie University (AU)

(72) Inventors: Stephen Fung, Dundas Valley (AU); Alexander von Brasch, Cremorne (AU); Tadeusz Jurkiewicz, Rozelle (AU)

(73) Assignee: COCHLEAR LIMITED, Macquarie University (AU)

( * ) Notice: Subject to any disclaimer, the term of this patent is extended or adjusted under 35 U.S.C. 154(b) by 550 days.

(21) Appl. No.: 15/612,379

(22) Filed: Jun. 2, 2017

(65) Prior Publication Data

US 2018/0352349 A1 Dec. 6, 2018

(51) Int. Cl.
*H04R 25/00* (2006.01)

(52) U.S. Cl.
CPC ..... *H04R 25/65* (2013.01); *H04R 25/606* (2013.01); *H04R 2225/67* (2013.01)

(58) Field of Classification Search
CPC .. H04R 25/65; H04R 25/606; H04R 2225/67; H01F 1/00; H01F 13/003
See application file for complete search history.

(56) References Cited

U.S. PATENT DOCUMENTS 7,175,589 B2 * 2/2007 Deem ..... A61B 17/12 128/898
9,078,711 B2 7/2015 Quick
10,031,559 B1 * 7/2018 Hamel ..... H01F 1/0306
2004/0139975 A1 * 7/2004 Nelson ..... A61F 2/20 128/848
2010/0292759 A1 11/2010 Hahn
2014/0024919 A1 1/2014 Metzenthen
2015/0012058 A1 * 1/2015 Crawford ..... H04R 25/00 607/57
2015/0377832 A1 * 12/2015 Fung ..... A61N 1/372 702/65
2016/0055358 A1 * 2/2016 Paul ..... G07D 7/04 235/450
2016/0381474 A1 * 12/2016 Gustafsson ..... H04R 25/606 600/25

* cited by examiner

*Primary Examiner* — Kaylee R Wilson
(74) *Attorney, Agent, or Firm* — Edell, Shapiro & Finnan, LLC

(57) ABSTRACT

A wearable component of an implantable medical device adapted to work with a sensor that detects the strength of the magnetic field emanating from a magnet situated in the implanted portion of the device. The wearable component can be fitted with a magnet that can be programmed or adjusted to the required strength. The system can automatically determine the required magnet strength, and also program the magnet to have the required value. The technology removes the conventional means or the need of audiologist/clinician to perform manual determination of the magnet strength by trial-and-error, and streamlines the process of magnet determination. The tedious and error-prone manual process can now be an automated additional step in the process of fitting an auditory prosthesis. The system removes the need for manual intervention and guess-work by the clinician fitting the wearable component. The system helps to standardize fitting practice across clinics.

19 Claims, 7 Drawing Sheets

CONTROLLED FITTING OF AN IMPLANTABLE MEDICAL DEVICE

TECHNICAL FIELD

The technology described herein generally relates to fitting of implantable medical devices, and more particularly relates to implants that utilize magnets for their proper placement.

BACKGROUND

Hearing loss is a leading form of disability in the developed world, due in part to increased longevity in the population at large, as well as exposure throughout life to a variety of sound sources that have damaging long-term effects on the delicate internal workings of the human ear.

Hearing implants have traditionally comprised an external speech processor unit worn on the body of the recipient and a receiver/stimulator unit, which may be implanted in the recipient's skull, and has a portion that extends directly into the inner ear. For example, in one type of cochlea implant, the external speech processor detects external sound and converts the detected sound into a coded signal through a suitable speech processing strategy. The coded signal is sent to the implanted receiver/stimulator unit via a transcutaneous link. The receiver/stimulator unit processes the coded signal to generate a series of stimulation sequences which are then applied directly to the auditory nerve via an array of electrodes positioned within the cochlea.

The effectiveness of an auditory prosthesis such as a cochlear implant depends not only on the design of the particular unit but also on how well it is configured for, or "fitted", to the individual recipient. The fitting of the prosthesis, sometimes also referred to as "programming" or "mapping", creates configuration settings and other data that define the specific characteristics of the signals (acoustic, mechanical, or electrical) delivered to the recipient.

One aspect of fitting includes identifying or characterizing various performance or operational metrics of the prosthesis that are particular to the recipient, and fine-tuning the prosthesis configuration settings and other data based on those metrics. Typically, an audiologist or clinician uses a hearing implant fitting system comprising interactive software and computer hardware to create individualized recipient map data that are digitally stored on the fitting system and ultimately downloaded to a recipient's auditory prosthesis. The audiologist or clinician can control the fitting system to carry out one or more of the functions of mapping, neural response measuring, acoustic stimulating, and/or recording of neural response measurements and other stimuli.

The discussion of the background herein is included to explain the context of the technology. This is not to be taken as an admission that any of the material referred to was published, known, or part of the common general knowledge as at the priority date of any of the claims found appended hereto.

Throughout the description and claims of the application the word "comprise" and variations thereof, such as "comprising" and "comprises", is not intended to exclude other additives, components, integers or steps.

SUMMARY

The instant disclosure addresses the transcutaneous retention of a wearable component of a medical device that comprises external (worn) and implanted portions. In particular, the disclosure comprises a method for achieving a customized fit, and a wearable component that is customized to a recipient's retention needs.

In some embodiments, the disclosure includes use of a sensor to measure the magnetic field strength of the implanted magnet. The measured field strength is communicated to a clinical programming system, which selects and recommends the appropriate strength of magnet. The clinical programming system adjusts the field strength of the external magnet in order to achieve the recommended magnetic field strength, and can further prompt the clinician to adjust the position of the external magnet to improve its fit, if needed.

In some embodiments, the disclosure includes a system that can determine the magnet field strength required to achieve the desired retention of an implantable medical device, and can magnetize an external component to this strength, as part of a streamlined clinical fitting process.

The disclosure still further includes a method of fitting a medical device to a recipient, comprising: positioning an external portion of the device in close proximity to an internal portion of the device implanted in the recipient, wherein the internal portion comprises a first magnet, and wherein the external portion comprises a second magnet, using a sensor to measure the magnetic field strength of the first magnet; communicating a measured field strength of the first magnet to a programming module; using the programming module to select an optimal field strength for the second magnet based on the measured field strength of the first magnet; and adjusting the field strength of the second magnet, thereby ensuring that the recipient experiences a comfortable fit of the external portion of the device.

BRIEF DESCRIPTION OF THE DRAWINGS

Like reference symbols in the various drawings indicate like elements.

DETAILED DESCRIPTION

Figure 1:
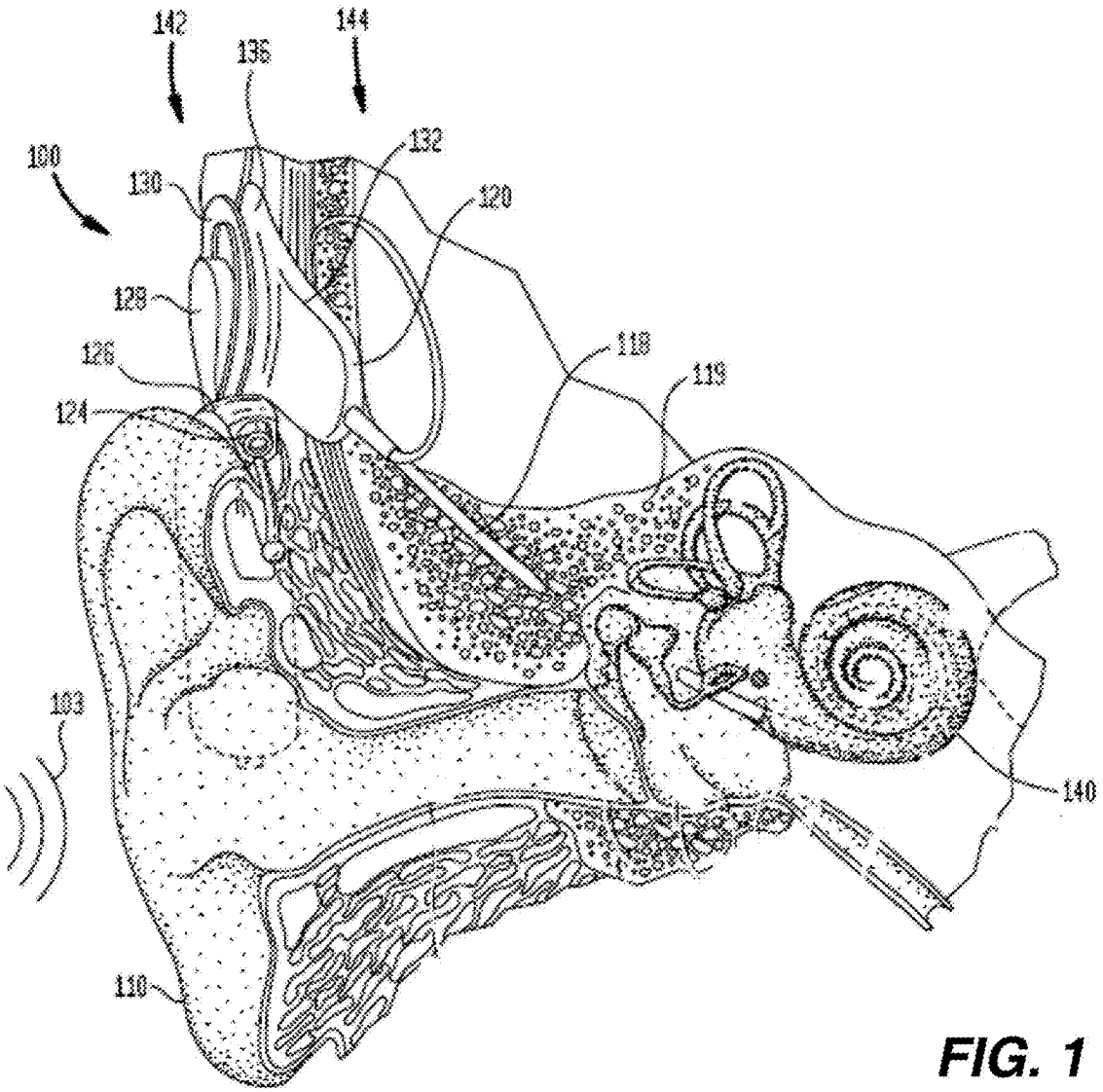
FIG. 1 shows a cochlear implant suitable for use with the instant technology.

The instant technology is directed to fitting of implantable medical devices that utilize magnets for their proper placement. Thus, the technology is applicable to medical devices that have an implanted (internal) portion and an external portion, wherein both the internal and external portions include a magnet. The internal magnet and the external magnet are such that they attract one another transcutaneously in order that the external magnet serves to retain the external portion of the device in position to maintain proper functioning of the device.

For example, in the case of an active medical implant with a transcutaneous data and/or power link, the implanted and external magnets align with one another to position internally and externally situated radiofrequency (RF) coils. The effectiveness of such an induction link is sensitive to the placement, i.e., alignment of and distance between, of the two coils. The present disclosure addresses the problem that the external magnet strength needs to be selected individually for each recipient, and depends on the thickness of the skin flap that is interposed between the external and implanted portions of the device.

Many audioprostheses rely on a magnetic coupling between an external (such as wearable) component that comprises either the sound processor or charger (for implants having a battery), and an internal component such as an implanted stimulator, in order to secure the device to its recipient. The strength of the magnets needs to be chosen so that the device doesn't become loose or dislodged during the recipient's everyday activities. On the other hand, if the magnetic forces of attraction are too strong, too much pressure on the recipient's skin can result, which in turn can lead to continued discomfort and even tissue damage such as necrosis.

In practice, there is considerable variation in required magnet strength across the population of recipients due in large part to the variation in the thickness of the human skin—for example, between 2 and 10 mm or even more—that interposes itself between the internal and external magnets. Other aspects of the human skin that are harder to quantify but which nevertheless influence the extent to which the magnetic field is mediated include the nature of skin tissue itself, any layers of fat or subcutaneous tissue, as well as variability of the surgeon's positioning.

Because the clinicians who perform the fitting and programming of the sound processor have very little time to optimize magnet placement during the fitting procedure, it is often required that the recipient returns to the clinic for adjustments if the initial fit proves to be the cause of discomfort. That becomes a burden on clinics, particularly as the recipient population grows.

Typically the internal portion of a medical device is placed in the recipient by a surgeon. For example, a region of skin is cut out to make a skin flap which is folded back to reveal an area of bone to which the internal portion is affixed. A region of bone may be drilled away to accommodate the implant, and the implant is attached to the recipient, for example by bone bed drilling. The skin flap is then repositioned to cover the internal portion of the device. Sometimes the surgeon must reduce the amount of (such as thickness of) skin that covers the internal portion of the device so that the recipient does not see an obviously elevated area of skin in the region of the implant, and/or to improve the magnetic coupling between the internal and external magnets. The degradation in strength of the field from the internal magnet, as felt by the external magnet, arises from the presence of the skin flap which interposes itself between the two magnets, increasing the distance between them. There is quite a large variation in the effect on the field of the internal magnet across the recipient population. Even in classes of medical devices in which the magnet on the inside is always of the same strength and size, thereby removing one possible contributor to variability, a clinician or recipient usually has to experiment in choosing the right strength for the external magnet.

Figure 2:
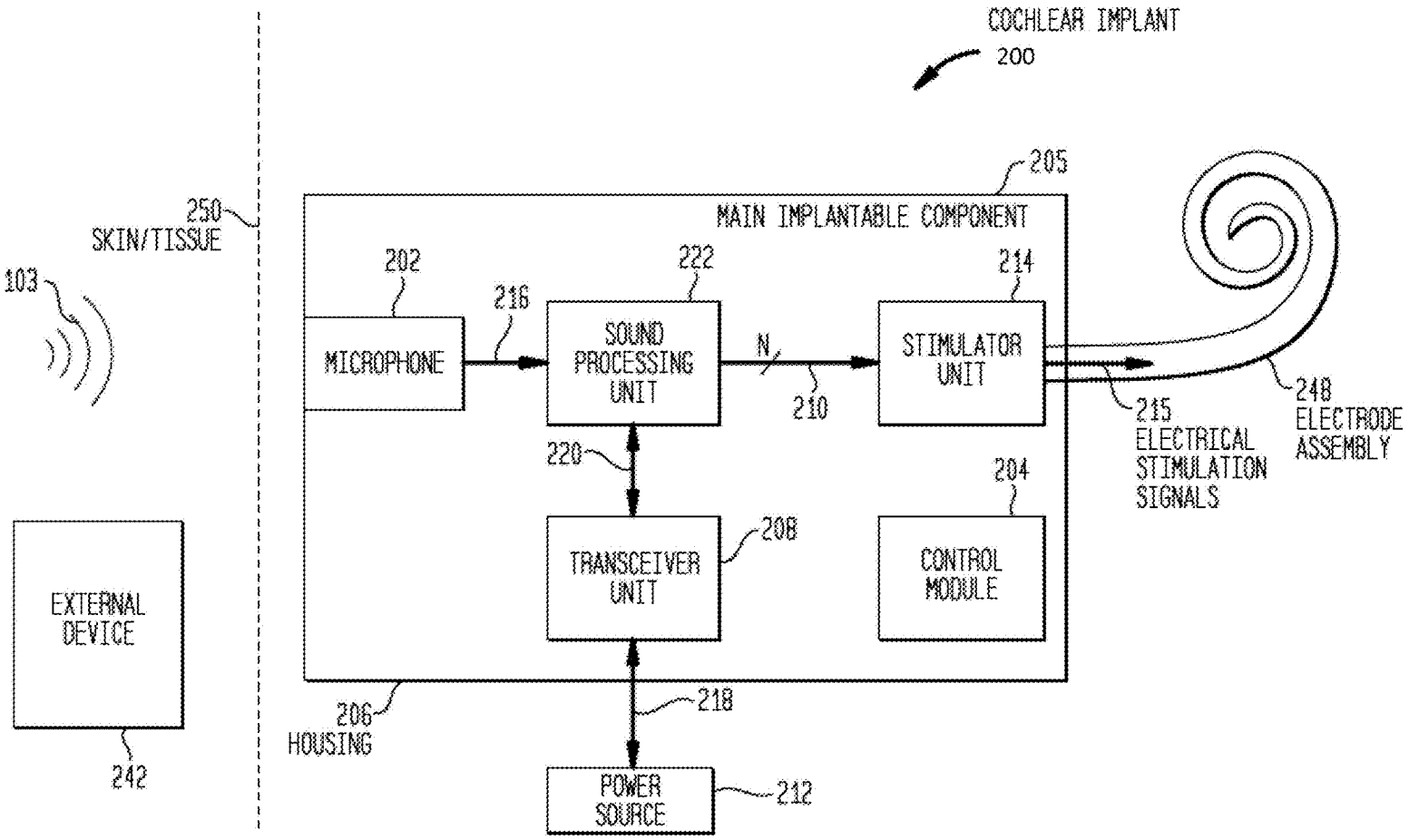
FIG. 2 shows schematically a totally implantable cochlear implant suitable for use with the instant technology.
Figure 3:
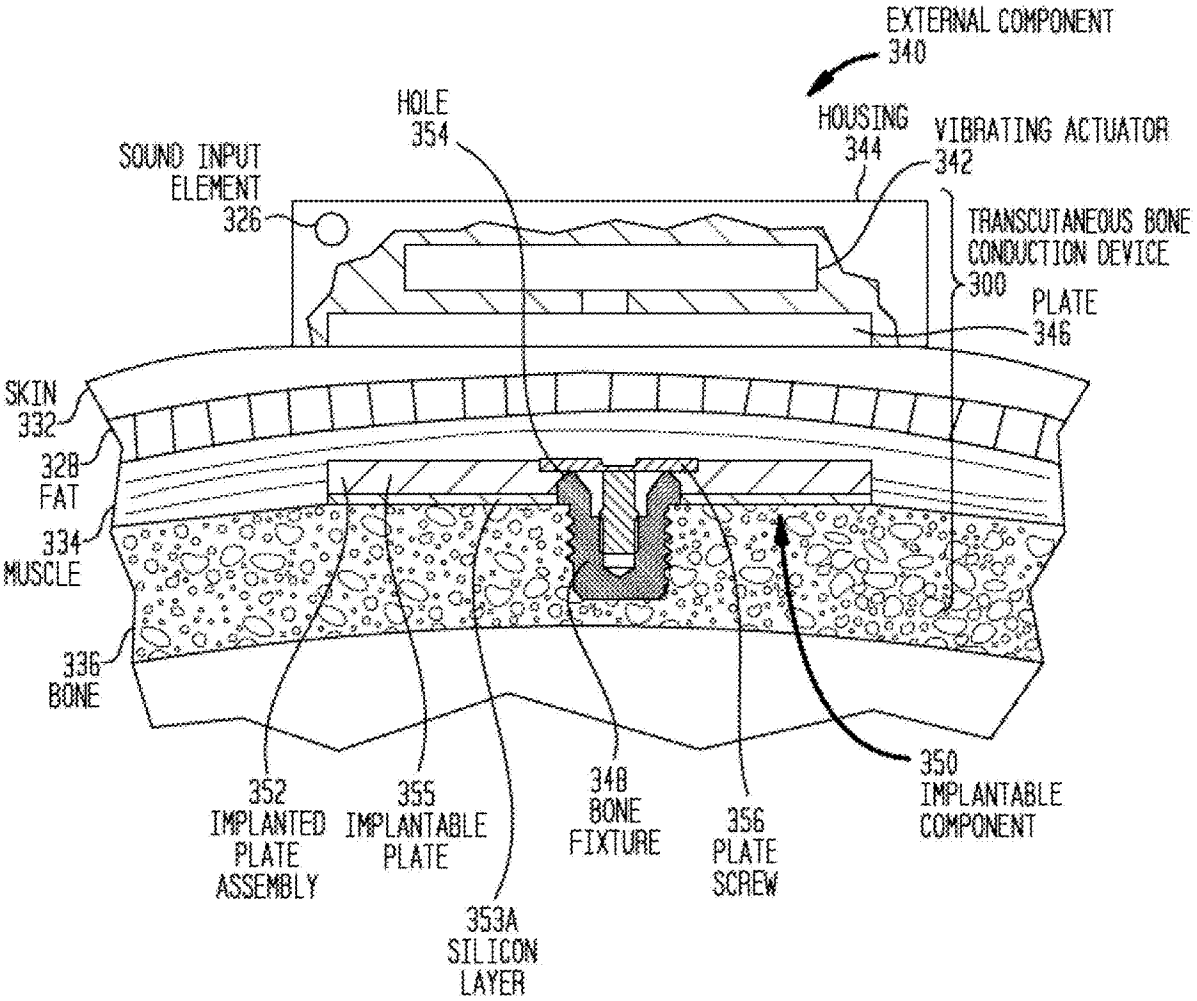
FIG. 3 shows a bone-conduction auditory prosthesis.

Examples of types of auditory prosthesis that can be adapted to incorporate the technology herein are shown in FIGS. 1-3. It is to be understood that the technology and its applications are not limited to these particular types of auditory prosthesis, or auditory prostheses more generally (unless stated otherwise). The technology is broadly applicable to medical devices that use magnets for transcutaneous retention of a wearable component.

FIG. 1 depicts a cochlear implant system 100 that comprises an internal component 144 and an external component 142 having a behind-the-ear (BTE) sound processor 124 that can detect sounds 103, and a separate coil 128/130 that is connected to the BTE processor by a cable (not shown in the drawing).

Internal component 144 typically has an internal (implanted) receiver/transceiver unit 132, a stimulator unit 120, and an elongate stimulating assembly 118. Elongate stimulating assembly 118 has a proximal end connected to stimulator unit 120, and a distal end implanted in cochlea 140. Stimulating assembly 118 extends from stimulator unit 120 to cochlea 140 through mastoid bone 119.

The internal receiver/transceiver unit 132 permits the cochlear implant system 100 to receive and/or transmit signals to a portion 126 of the external component and includes an internal coil 136, and preferably, a magnet (not shown) fixed relative to the internal coil 136. Internal coil 136 is typically a wire antenna coil comprised of multiple turns of electrically insulated single-strand or multi-strand platinum or gold wire. The electrical insulation of internal coil 136 is provided by a flexible silicone molding (not shown). Internal receiver unit 132 and stimulator unit 120 are hermetically sealed within a biocompatible housing (not shown), and are sometimes collectively referred to as a stimulator/receiver unit. In use, implantable receiver unit 132 may be positioned in a recess of the temporal bone adjacent auricle 110 of the recipient.

Magnets in the external and internal components facilitate the operational alignment of the external and internal coils, enabling internal coil 136 to receive power and stimulation data from external coil 130. Various types of energy transfer, such as infrared (IR), electromagnetic, capacitive and inductive transfer, may be used to transfer the power and/or data from external device to cochlear implant. In certain instances of system 100, external coil 130 transmits electrical signals (e.g., power and stimulation data) to internal coil 136 via a radio frequency (RF) link.

In FIG. 1, the sound processor is shown mounted close to the recipient's ear but the technology is not limited to such positioning, and in other embodiments, an off-the-ear (or "button") sound processor can be used. An example is described in U.S. patent application Ser. No. 15/166,628, filed May 27, 2016 having first named inventor Tadeusz Jurkiewicz, and which is incorporated herein by reference. In systems that use a "button" processor, the radiofrequency coil and the external magnet are integrated into a single package. This type of "off-the-ear" device is typically heavier than a conventional coil (because it contains the sound processing electronics and battery), and so requires greater retention strength. Sometimes a soft pad, made from a thin compliant material, is used to avoid localized pressure concentration. The soft-pads are positioned between the external component and the skin, and allow the use of stronger magnets by distributing the force over a wider area of skin. Active bone conduction and middle ear devices also commonly use an off-the-ear sound processor.

In some auditory prostheses of the type shown in FIG. 1, the strength of the implanted (internal) magnet is common to all recipients, which means that it is only necessary to adjust the field strength of the external magnet. In many systems, a clinician must make a selection of the external magnet from a set of (such as 5-10) magnets having predefined strengths that cover a range of magnet strengths. The clinician can keep on trying different magnets from the set, but that requires a fair amount of guesswork, and also assumes that one of the predefined set will be optimal, which may not always be the case. Furthermore, it is wasteful to provide a set of magnets with every implant kit, because inevitably the majority of the magnets are never used. As further described herein, in the instant technology, it is possible to optimize the magnetic field strength of the external magnet to achieve better placement.

FIG. 2 shows schematically a block diagram of a totally implantable cochlear implant system 200. Totally implanted devices can have a coil/magnet configuration to facilitate coupling with an external component such as a charger, or an external sound processor for use in difficult hearing environments. An example of such a totally implantable acoustic device is Carina™, available from Cochlear Limited, Sydney, Australia.

In system 200, all components are configured to be implanted under one or more layers of skin tissue 250 of a recipient. Therefore, system 200 operates, for at least some of the time, without the need of an external device. An external device 242 can be used to charge an internal battery 212, to supplement the performance of the implanted microphone 202, or when the internal battery no longer functions. External device 242 may be a dedicated charger or a sound processor as used with other types of cochlear implant such as those shown in FIG. 1. External device 242 can be secured in place via a magnetic coupling with a magnet in the implanted portion.

System 200 includes a main implantable component 205 having a hermetically sealed, biocompatible housing 206. Disposed in main implantable component 205 is a microphone 202 configured to sense a sound signal 103. Microphone 202 may include one or more components to preprocess the microphone output. As an alternative, the microphone and other aspects of the system can be included in an upgrade or tethered module as opposed to in a unitary body as shown in FIG. 2.

An electrical signal 216 representing sound signal 103 detected by microphone 202 is provided from the microphone to sound processing unit 222. Sound processing unit 222 implements one or more speech processing and/or coding strategies to convert the pre-processed microphone output into data signals 210 for use by stimulator unit 214. Stimulator unit 214 utilizes data signals 210 to generate electrical stimulation signals 215 for delivery to the cochlea of the recipient (not shown). In the example of FIG. 2, a stimulating electrode assembly 248 delivers signal 215 to the cochlea.

Cochlear implant system 200 also includes a power source 212. Power source 212 may comprise, for example, one or more rechargeable batteries. Power can be received from a suitably positioned external device 242 and stored in power source 212. The power may then be distributed 218 to the other components of system 200 as needed for operation. For ease of illustration, main implantable component 205 and power source 212 are shown separate from one another. However, power source 212 can alternatively be integrated into the hermetically sealed housing 206, or can be part of a separate module coupled to component 205.

Main implantable component 205 further comprises a control module 204, which can include various components for controlling the operation of implant 200, or specific components of it. For example, controller 204 may control the delivery of power from power source 212 to other components of cochlear implant system 200.

Cochlear implant system 200 further comprises a receiver or transceiver unit 208 that permits the system to transcutaneously receive and/or transmit signals 226 such as power and/or data to/from an external device 242. For example, signals representative of sound detected by an external microphone (not shown) can be transmitted from external device 242 to receiver or transceiver unit 208, and subsequently conveyed to sound processing unit 222 as demodulated or decoded signal 220.

As used herein, transceiver unit 208 refers to any collection of one or more implanted components which form part of a transcutaneous energy transfer system. Further, transceiver unit 208 includes any number of component(s) which receive and/or transmit data or power, such as, for example, a coil for a magnetic inductive arrangement, an antenna for an alternative RF system, capacitive plates, or any other suitable arrangement. Various types of energy transfer, such as infrared (IR., electromagnetic, capacitive and inductive transfer, can be used to transfer the power and/or data from external device 242 to implantable component 205. To optimize such transfer, external device 242 is typically magnetically aligned with implantable component 205.

For ease of illustration, cochlear implant system 200 is shown having a transceiver unit 208 in main implantable component 205. In alternative arrangements (not shown), cochlear implant system 200 includes a receiver or transceiver unit which is implanted elsewhere in the recipient outside of main implantable component 205.

In the illustrative arrangement of FIG. 2, external device 242 comprises a power source (not shown) disposed in a BTE unit. External device 242 also includes components of a transcutaneous energy transfer link formed with transceiver unit 208 to transfer the power and/or data to cochlear implant system 200.

FIG. 3 shows an embodiment of a passive transcutaneous bone conduction device 300. Device 300 includes an external component 340 and an implantable component 350. Such devices do not have a coil but instead comprise an actuator in the sound processor that transfers vibrations through the recipient's skin 332 from external component 340 to implantable component 350.

In the embodiment shown in FIG. 3, a vibrating actuator 342, located in housing 344 of external component 340, is coupled to plate 346. Vibrations produced by the actuator 342 are transferred from plate 346 across the skin 332 and one or more layers of fat 328, muscle 334, and bone 336, to plate 355 of implanted plate assembly 352. This may be accomplished as a result of mechanical conduction of the vibrations through the skin, resulting from the external component 340 being in direct contact with the skin and/or from the magnetic field between the two plates.

In the embodiment shown, implanted plate assembly 352 is rigidly attached to bone fixture 348. Other types of bone fixture (not shown) may be used instead of bone fixture 348. Implantable plate assembly 352 includes through-hole 354 that is contoured to the outer surface of bone fixture 348. Plate screw 356 is used to secure plate assembly 352 to bone fixture 348. As can be seen in FIG. 3, the head of the plate screw 356 is larger than the hole through the implantable plate assembly 352, and thus the plate screw 356 positively retains the implantable plate assembly 352 to the bone fixture 348.

In an exemplary embodiment, the vibrating actuator 342 is a device that converts electrical signals into vibration. In operation, sound input element 326 converts sound into electrical signals. Specifically, the transcutaneous bone conduction device 300 provides these electrical signals to vibrating actuator 342, or to a sound processor (not shown) that processes the electrical signals, and then provides those processed signals to vibrating actuator 342. The vibrating actuator 342 converts the electrical signals (processed or unprocessed) into vibrations. Because vibrating actuator 342 is mechanically coupled to plate 346, the vibrations are transferred from the vibrating actuator 342 to plate 346.

Plate 346 may be in the form of a permanent magnet and/or in another form that generates and/or is reactive to a magnetic field, or otherwise permits the establishment of magnetic attraction between external component 340 and the implantable component 350 sufficient to hold the external component 340 against the skin 332 of the recipient.

Implanted plate assembly 352 is part of the implantable component 350, and comprises implantable plate 355 and silicon layer 353A. Implantable plate 355 is made of a ferromagnetic material that can be in the form of a permanent magnet that generates and/or is reactive to a magnetic field, or otherwise permits the establishment of a magnetic attraction between the external component 340 and the implantable component 350 sufficient to hold the external component 340 against the skin 332 of the recipient. Efficacy of the device depends on proper alignment of the external and implanted components.

In some external devices it is possible to make micro adjustments of the magnet position, for example by use of a screw, thereby altering the distance between the external and internal magnets.

Figure 4:
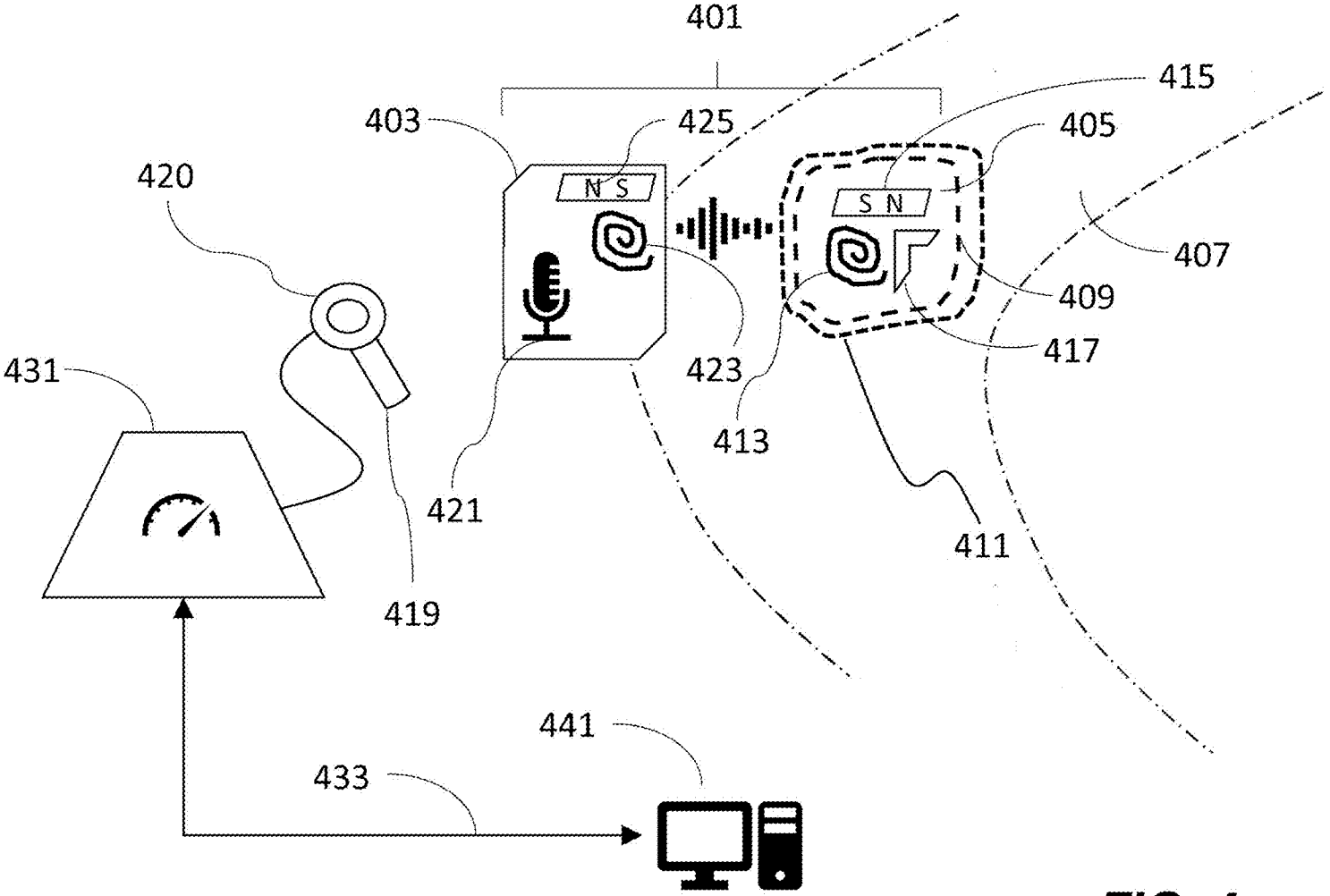
FIG. 4 shows schematically an implantable medical device as described herein.
Figure 5:
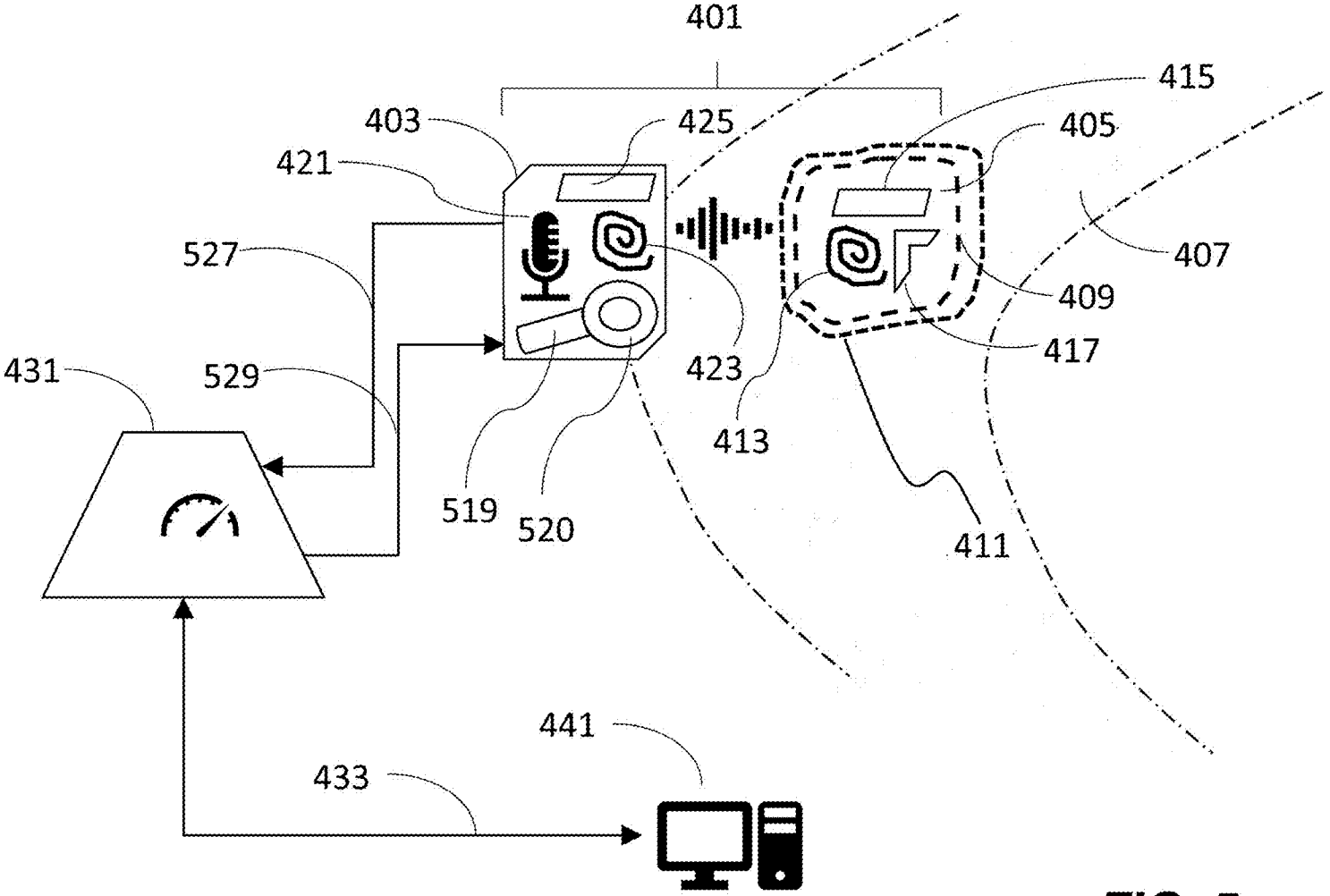
FIG. 5 shows schematically a second embodiment of an implantable medical device as described herein.

Two embodiments of the technology are shown schematically in FIGS. 4 and 5, wherein like reference numerals refer to like elements. An implantable medical device system 401 comprises an external portion 403 and an internal portion 405, situated within a portion 407 of a recipient's anatomy. Internal portion 405 is typically seated in a recessed area 409 of bone that has been drilled out. A flap of skin 411 covers the internal portion 405 of the device and separates it from the external portion 403.

Internal portion 405 of the device comprises a number of components, including an internal magnet 415, and other electronic components that depend on the nature of the implant. For example when the implant is a cochlea implant, the electronic components 417 include an electrode for delivering a stimulus to the recipient's inner ear. In some embodiments, internal portion 405 also includes an internal radio frequency coil 413 for communicating with the external portion 403 of the device. In transcutaneous bone conduction devices (as in FIG. 3), external portion 403 and internal portion 405 are directly coupled to one another.

External portion 403 is positioned against the surface of the recipient's skin in the vicinity of internal portion 405. In the case of an auditory prosthesis, generally the external portion is positioned away from the tissue of the outer ear, so there is no interference with the anatomy of the ear. External portion 403 can be a behind-the-ear sound processor, or can be an off-the-ear ("button") processor.

External portion 403 can comprise a sound processing unit 421 in the case that it is an off-the-ear portion of an auditory prosthesis. External portion 403 also comprises an external radio frequency coil 423 positioned to be in communication—such as inductively—with internal radio frequency coil 413. The inductive coupling between the internal and external coils can be used to transmit sound-signals (such as in an auditory prosthesis) and/or to charge a battery in the internal portion (such as in a totally implantable cochlear implant and in many other types of implant).

External portion 403 further includes an external magnet 425 that attracts and aligns magnetically with internal magnet 415 in order to optimally locate the external portion 405 of the device in a position of comfort for the recipient. One constraint on the size of the external magnet is that it can't be so large that it interferes with the RF/induction link between coils 413, 423.

According to some embodiments of the instant technology, a sensor 419 is used to measure the field strength of the internal magnet 415 as felt at the recipient's skin. An example of such a sensor is a Hall effect sensor, which operates such that when a current runs through a conductor in the presence of a magnetic field, a voltage is induced across the conductor in proportion to the magnetic field strength component perpendicular to the direction of flow of the current. As further described herein, sensor 419 is in communication with clinical programming system 431. The measured field strength is communicated to clinical programming system 431, which determines the strength of external magnet required to achieve the desired retention for the wearable external component. In some embodiments, the clinical programming system can adjust the field strength of the external magnet in order to achieve the determined magnet strength. The field strength is adjusted by magnetizing the magnet of the external component in the clinical setting (e.g., in the office of a medical specialist, such as an audiologist). Magnetization can take place while the external magnet is housed within the external component, such as within a closed casing.

In the embodiment of FIG. 4, sensor 419 is part of a separate tool that can be brought into proximity, such as by being placed in contact with, of external portion 403. Alternatively, sensor 419 can be attachable to and detachable from external portion 403, such as by being attached to the external portion before or during positioning of the external portion of the device and subsequently removed. In this way, the sensor does not add to the bulk of external portion 403 and the external component does not comprise any non-essential components. The sensor can be retained by the clinic so that it can be used and re-used as needed. In the instance that the sensor is separate from the external portion of the medical device, both sensor and medical device can be provided by the same manufacturer.

In the embodiment of FIG. 5, external portion 403 comprises sensor 519 that is configured to measure the magnetic field strength of internal magnet 415. In normal operation of the device (outside of the fitting process), the sensor does not draw any current and therefore will not affect battery life or impose an undue load on the functioning of the device. Clinical programming tool 431 is typically situated in the clinic where the implantation and fitting procedure is taking place. Clinical programming tool 431 provides power to sensors 419, 519 as applicable, and receives and processes magnetic field strength readings from the sensor, whether the sensor is part of a clinical tool or is integrated into the external portion of the implantable device. Clinical programming tool 431 communicates with programming software executed on a computer 441. The computer 441 can be configured to communicate with the sound processor via the clinical programming tool 431 or another interface that communicates wirelessly or via a conductor to the sound processor. The clinical programming tool 441 also provides electrical signals to the magnetizing coil 420, 520 to adjust the strength of the external magnet, as further described herein.

In FIG. 5, external portion 403 of the medical device system 401 communicates with clinical programming tool 431 via one or more connections 527, 529. Connections 527, 529 can be wired or wireless and if wireless may require that external portion 403 contains a wireless transceiver, such as a Bluetooth or wifi adaptor. When communicating with clinical programming tool 431 via wired connections, it is to be understood that the wires are removable and are only present during the fitting of the medical device. Thus, wires that mediate communication may be inserted, such as plugged into, suitably configured ports or jacks (such as a micro-USB socket), on the external portion 403. In some embodiments, a single wire (instead of a pair of wires 527, 529) can communicate signals from sensor 419 to tool 431 as well as communicate signals from tool 431 to external magnet 425, as further described herein, in other embodiments separate wires mediate the two communications. Clinical programming tool 431 can be in communication with a computing device 441 such as a personal computer via connection 433. Connection 433 can be wired or wireless such as wifi or other wireless network. Computing device 441 can be located in the same room as the recipient while the prosthesis is being fitted or can be situated in a remote location, such as an adjacent room or another part of the clinic. Computing device 441 is used to control the fitting process of the implant, for example in the case of an auditory prosthesis, by setting electrical stimulation thresholds that are comfortable and evoke a hearing percept. The computing device can also interpret data from sensor 419, 519. Accordingly, computing device 441 can be programmed with instructions for taking in data such as the magnetic field strength felt by the external portion 403 of the device and that is attributable to the internal magnet 415, as measured by sensor 419 or 519.

Computing device 441 can be further programmed with instructions for calculating a desired magnetic field strength, or a range of magnetic field strengths, for external magnet 425, and to communicate that information via connection 433 to clinical programming tool 431. Computing device 441 can be programmed with instructions to communicate the current that needs to be applied to the magnetizing coil 420, 520 to adjust the strength of magnet 425. Computing device 441 can also allow clinicians to enter or configure a retention level for a given recipient, meaning that certain individuals may prefer a higher or lower level of magnetic field strength than that suggested by the system. Such adjusted preferences may arise for individuals who undergo a lot of heavy physical activity (and therefore require a stronger retention), or persons who have heightened sensitivity to touch (and therefore require a weaker retentions).

Clinical programming tool 431 therefore typically serves as an interface between computing device 441 and the external portion 403 of the medical device. In particular, it accepts sensor readings and converts them in a form to be interpreted by software that runs on the computing device. In some embodiments, the clinical programming tool also accepts information from computing device 441 and acts on it in order to deliver appropriate amounts of electrical current to the magnetizing coil 420, 520 to adjust the external magnet of the device to control its set up (magnetization).

In one embodiment, the clinical programming tool notifies the clinician of a particular magnet strength to select, such as from a set of magnets, such as permanent magnets, of predetermined strengths.

In another embodiment, the external magnet 425 comprises a low coercivity magnetic material (e.g., a ferromagnetic material such as Alnico) that can be magnetized in a clinical setting (thereby benefiting from use of aspects such as mains power supply and safe operating temperatures). This allows the resulting strength of the magnet 425 to be customized to the recipient's retention needs (because magnetization is dependent on a characteristic of a recipient of the implantable medical device). In some embodiments the external magnet 425 comprises a single piece of low coercivity magnetic material. In other embodiments, the external magnet 425 comprises a combination of magnetic materials. The wearable external component 403 can form a closed case around the magnet 420 so that the low coercivity material is magnetized through the casing.

In some embodiments, external magnet 425 is made from a combination of two different types of magnetic materials, one of which has a high magnetic coercivity, and the other of which has a low magnetic coercivity. (The coercivity is a property of a magnetic material that permits it to retain its magnetic field.) Using the two materials in combination typically involves placing them adjacent to one another so that their directions of magnetization are aligned parallel or anti-parallel to one another. The field strength of the combined materials can be adjusted by applying a short-lived (pulse of) electric current to the magnetizing coil 420, 520 while in close proximity to the low coercivity material. When the applied current is switched off, the magnetic field induced by the current persists. Typically the pulse of current is applied via a magnetizing coil 420 or 520.

The high magnetic coercivity material is one whose magnetic field strength cannot be adjusted in a clinical setting (because the current and/or temperature conditions needed to change its magnetization exceed levels that are acceptable in a clinic). Such magnets are typically made from Rare Earth (Lanthanide) elements such as neodymium, or alloys containing the same. Such materials are useful in applications where a compact size and low weight are highly desirable because they have a high magnetic field strength per unit volume of magnetic material.

The low magnetic coercivity material is such that its sense of magnetization can be reversed in a clinical setting, given an appropriate current. The low coercivity magnet is typically a ferromagnetic material (such as Alnico) that is likely to be contained within the housing of the external device (e.g., permanently or removably enclosed within a closed casing).

Typically the values of the low and high coercivities are related by a factor in the range 5-10, 10-15, or 15-25, which is to say that the value of the high coercivity material may be as much as 5-25 times greater than the value of the low coercivity material.

Examples of suitable low coercivity materials are various forms of AlNiCo (alloy of aluminium, nickel and cobalt), which have coercivities in the range 50 kA/m-480 kA/m.

Examples of suitable high coercivity materials include rare earth magnets such as: NdFeB (e.g., $Nd_2Fe_{14}B$), $SmCo_5$, Sm $(Co,Fe,Cu,Zr)_7$, all of which have coercivities in the range 450-2000 kA/m.

Additional materials that can be considered include various ferrites, such as "soft" ferrites (e.g., manganese-zinc, and nickel-zinc) and "hard" ferrites (e.g., strontium, barium, and cobalt).

In some embodiments, the first coercivity and the second coercivity are sufficiently different from one another that the high coercivity magnet retains its pre-existing magnetization while the magnetization of the low coercivity magnet is adjusted in a clinical setting. In some embodiments, the first coercivity is at least 400 kA/m greater than the second coercivity.

A magnetization coil 420, 520 is used to deliver an electric current pulse to the low coercivity material. The coil can be integrated with the external component 403 or form part of the clinical programming tool 431. The pulse adjusts the magnetization of the low magnetic coercivity material. Thus, in combination with the existing magnetization of the adjacent high coercivity material, the overall flux of the pair can be modified to reinforce or subtract from the magnetic flux of the high coercivity material. For example, the combination is additive for a "thick" skin flap and is subtractive for a "thin" skin flap.

Thus, by using such a combination of materials, it is possible to adapt a given external component to either an adult or a pediatric recipient. In a person such as a juvenile, in which there is a small or thin skin flap over the internal portion of the device, it would be appropriate to program the low coercivity material to have a magnetization direction in opposition to that of the permanent (high coercivity) magnet so that there is a net subtraction of flux and a lower total magnetic field strength. Conversely, for an adult recipient, in which there is a need for a bigger magnet, it is appropriate to do the reverse and to add the flux from the low coercivity material to that of the permanent magnet.

In these embodiments, the high coercivity magnet can be thought of as setting a baseline level of magnetic field strength. Thus, when compared to a set of magnets having predetermined strengths, the magnet made from high coercivity material can be chosen to have a field strength comparable to one commonly used in the set.

In some embodiments, the high coercivity magnet alone is sufficiently strong that it can be used to loosely secure the external portion of the device onto the skin of the recipient prior to making the adjustments necessary to ensure a proper fit.

Thus, in embodiments that utilize a magnet made from a combination of magnetic materials, clinical programming tool 431 provides a current pulse to the magnet (via the magnetization coil 420, 520), thereby setting it to the desired magnetic field strength. The use of such a magnet therefore greatly simplifies the fitting process since one combination of magnets can be made to work for all recipients. The use of a combination of magnets allows an increased granularity of field strengths to be programmed to the external magnets, which improves upon the limited number of strengths that are possible with the discrete set of magnets available in existing systems. Additionally, the weight of the external component doesn't change when the field strength is altered (whereas clinicians need to compensate for the weight of the magnets added/removed from the external component in some conventional systems). Still further, it allows a clinician to easily carry out trials or small adjustments to magnet retentions strength during a clinical programming session in a manner that is significantly easier than the laborious process previously involved.

In sum, communicating signals to a magnet includes communicating the signals to a coil that magnetizes the magnet, and can also include passing current through a conductor (that forms a coil around the magnet). In some embodiments, the magnetizing coil and circuitry are contained in the clinical programming tool, and control software is part of the fitting software running on the computer.

Fitting

Figure 6:
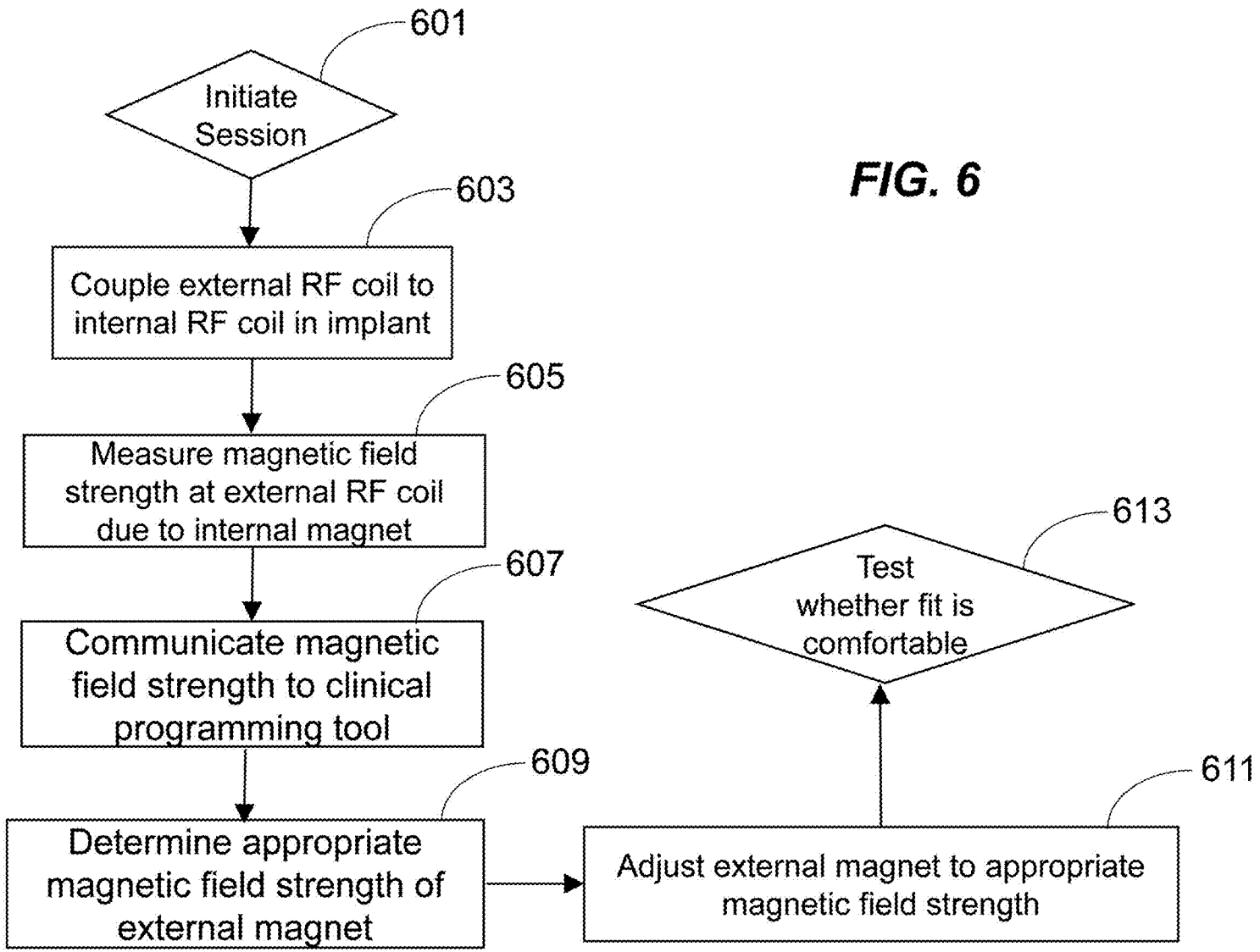
FIG. 6 shows a flow-chart of a process as described herein.

In operation, the practice of the technology can be accomplished in the following way, as outlined in FIG. 6.

For purposes of the technology herein, the fitting session is initiated 601 at a point in the clinical procedure when the internal portion 405 of the medical device has already been implanted in the recipient, such as by being positioned in a drilled out recessed portion of bone and covered by a flap of skin. It remains to properly position the external portion 403 of the medical device and provide an optimal fit for the recipient.

At step 603, the external portion of the implant is placed against the recipient's skin as close as is practical to the location of the internal magnet of the implant and so that the internal RF coil inductively couples with the external RF coil.

In a next step 605, the sensor attached to the clinical programming tool, or positioned in the external portion of the implant, measures the magnetic field strength felt by the external RF coil and arising from the internal magnet in the implant. It would be understood that steps 603 and 605 can be performed in any order, so that in certain embodiments, the magnetic field strength of the internal portion is measured by a sensor (and hence the thickness of the skin flap can be estimated) before the external portion of the system is attached to the recipient.

One aspect of the technology is that it can measure or estimate the skin-flap thickness and, under the assumption that the magnetic field strength of the implanted magnet is fixed, the in-built magnetic field sensor (Hall probe) reading is proportional to the separation of the two magnets, and hence is an indicator of the skin-flap thickness. As part of an integrated fitting scheme, this also allows a clinician to track variations of the skin-flap thickness over time.

The measured magnetic field strength is communicated 607 to the clinical programming tool. In conjunction with the computing device, the appropriate magnetic field strength of the external magnet is determined 609.

The external magnet in the external portion of the medical device is then adjusted 611 to have the field strength determined at 609. As is discussed elsewhere herein, this adjustment can comprise the clinician setting the magnetic strength of a low coercivity material by a magnetization process that's suitable for use in a clinic.

At this stage, the recipient can optionally be asked to assess 613 the comfortability of the fit. The comfortability of fit can be assessed simply by how much pressure the external portion of the device exerts on the recipient's skin, or it can be based on efficacy of the device, or by a combination of both.

If the coil pressure is judged to be comfortable by the recipient, nothing further may be required of this fitting process, and the rest of the programming session can continue. Alternatively, if the recipient responds that further adjustments would be preferred, the clinician can choose a different magnet from those available or, if the external magnet is adjustable, the system can automatically fine-tune its field strength via a fitting program. Such a fitting program can determine various parameters of the programming current pulse (amplitude, duration, modulation, etc.), to obtain the desired strength. Such a program can also have a feedback element, where the programmed strength is measured by the sensor system, and fine-tune adjustments are made as required.

In one embodiment, the package comprising the magnet programming coil and magnetic field sensor can be separate and attach to the sound processor coil, which consists of a RF coil and magnet. Alternatively, the external component comprises one or more magnetic field sensors, and an adjustable magnet. The components can be integrated as a single package that contains the RF coil, magnet programming coil, magnetic field sensor, and adjustable magnet. This package can be part of the sound processor package. Still other variations of these configurations are possible.

In some embodiments, the system reduces the possibility of interference between the magnetic field from the external magnet and the magnetic field from the implant disrupting the calculation. The programming system knows the current field as generated by the external magnet, and can set it to a pre-defined level. It is then able to perform mathematical/vector subtraction to determine the field from the implanted magnet. The system can, for example, calibrate itself by taking a reading when the internal magnet is not present, and one when it is, and by the difference of the two readings calculate the magnetic field strength of the implanted magnet.

Further benefits and advantages of the technology herein include: a significant reduction in the logistics of storing and handling different categories of magnets for each type of implant; providing an objective measure of required magnet retention strength, which simplifies and standardizes clinical practice; the technology provides a stand-alone clinician based system that notifies the clinician of which magnetic field strength to deploy.

The technology herein can apply to various types of implants. There is a growing number of implantable medical devices that rely on external power sources because they have an implanted battery that is rechargeable, which itself requires an ability to transfer charge via a transcutaneous link and a need to hold the charging device in place. Any device that requires a magnetic attraction for an external component to stay in place requires a fitting process, with a concomitant risk of recipient discomfort or pressure on the recipient's skin that can lead to skin damage.

Examples of implantable medical devices to which the instant technology can apply include, but are not limited to: deep brain stimulators, spinal stimulators (such as for alleviating pain), pacemakers, and auditory prostheses such as middle ear implants, bone conduction implants and cochlea implants.

Figure 7:
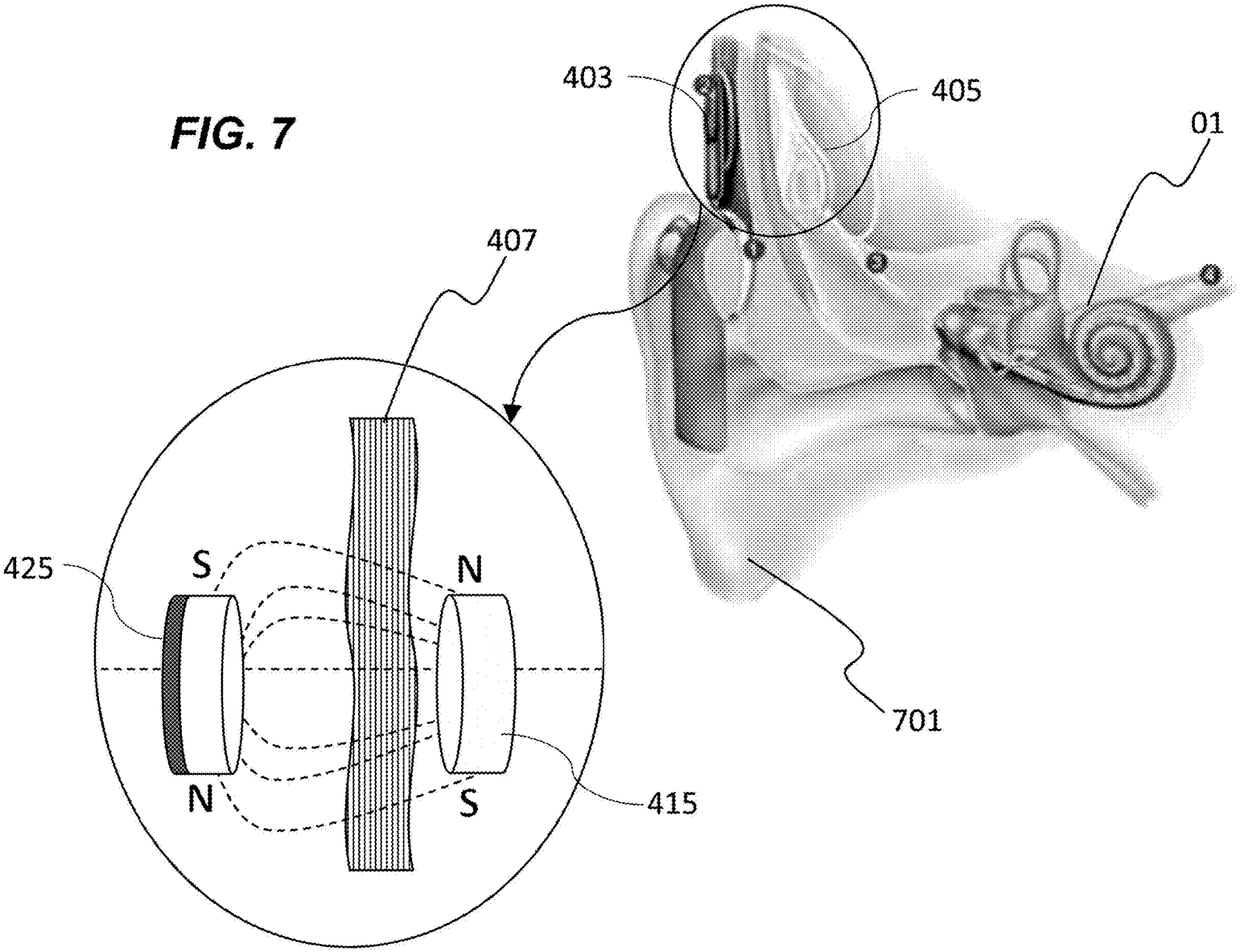
FIG. 7 shows a schematic of the field of an external magnet interacting with the field of an internal magnet, as felt outside a recipient's skin.

FIG. 7 shows a particular implementation of the technology in conjunction with an auditory prosthesis. Thus, the auditory prosthesis comprises an internal portion 405, embedded in a recipient's skull, and an external portion 403 mounted on the skin immediately outside the internal portion 405, adjacent the recipient's outer ear 701. The remainder of the auditory prosthesis, in this case a cochlea implant, is inserted into the recipient's cochlea 701. An exploded portion of FIG. 7 (inset) shows in cross section the skin 407 between the internal and external portions of the device. Internal magnet 415 is shown aligned with external magnet 425, with magnetic field lines between the two. External magnet 425 comprises two materials, one shaded in the figure; one material has high coercivity and one has low coercivity.

In another embodiment, the technology comprises an implantable medical device having an embedded sensor configured to measure the magnetic field strength of an implanted magnet, a transmitter that communicates the measured magnetic field strength to a clinical programming system, which selects and recommends an appropriate magnet strength for an external magnet, which is built into the external component of the device. The clinical programming system can then program the external magnet to deliver the required field strength. One advantage of this embodiment is that it is integrated and does not require a secondary tool to determine the magnet strength; the sensor that measures the magnet strength of the internal magnet is integrated into the external portion of the device.

All references cited herein are incorporated by reference in their entireties.

The foregoing description is intended to illustrate various aspects of the instant technology. It is not intended that the examples presented herein limit the scope of the appended claims. The invention now being fully described, it will be apparent to one of ordinary skill in the art that many changes and modifications can be made thereto without departing from the spirit or scope of the appended claims.

What is claimed:

1. An apparatus, comprising:

an external portion, configured to be held in contact with skin overlying an implantable portion configured to be implanted in a recipient and comprising an implantable magnet, wherein the external portion comprises:

an external induction coil, and at least one external magnet disposed in the external portion, wherein the at least one external magnet is formed from a low coercivity magnetic material configured to be magnetized to a selected magnetic strength in a clinical setting, wherein the selected magnetic strength optimizes, for the recipient, a transcutaneous coupling with the implantable magnet.

2. The apparatus of claim 1, wherein the at least one external magnet comprises a first magnet formed from the low coercivity magnetic material and a second magnet formed from a high coercivity magnetic material.

3. The apparatus of claim 2, wherein a magnetization direction of the first magnet is opposite to a magnetization direction of the second magnet.

4. The apparatus of claim 2, wherein the coercivity of the low coercivity magnetic material and the coercivity of the high coercivity magnetic material are sufficiently different to permit the second magnet to retain pre-existing magnetization while the first magnet is magnetized.

5. The apparatus of claim 4, wherein the coercivity of the high coercivity magnetic material is at least 400 kA/m greater than the coercivity of the low coercivity magnetic material.

6. The apparatus of claim 1, wherein the at least one external magnet comprises a single piece of magnetic material.

7. The apparatus of claim 1, wherein the external portion comprises a sensor configured to measure the strength of a magnetic field generated by the implantable magnet and to communicate with a programming system to which it transmits a measurement of the strength of the magnetic field generated by the implantable magnet.

8. The apparatus of claim 1, wherein the apparatus is a component of an implantable medical device selected from a group consisting of: an auditory prosthesis, a deep brain stimulator, and a spinal stimulator.

9. The apparatus of claim 1, comprising:

the implantable portion comprising the implantable magnet.

10. The apparatus of claim 9, wherein the implantable portion comprises a first induction coil configured to transcutaneously communicate with the external induction coil.

11. The apparatus of claim 1, wherein the external portion comprises a housing, and wherein the external induction coil and the at least one external magnet are disposed in the housing, and wherein the at least one external magnet is configured to be magnetized to the selected magnetic strength while positioned within the housing.

12. A kit comprising the apparatus of claim 1 and a sensor configured to measure a strength of a magnetic field generated by the implantable magnet and to communicate with a programming system.

13. The kit of claim 12, further comprising the programming system, wherein the programming system comprises:

a magnetization coil configured to generate a magnetic field that, when positioned in proximity to the at least one external magnet, magnetizes the low coercivity magnetic material to the selected magnetic strength.

14. A method comprising:

transcutaneously coupling an external induction coil of an external component with an implantable induction coil of an implantable component configured to implanted in a recipient, wherein the external component comprises at least one external magnet formed from a low coercivity magnetic material and the implantable component comprises an implantable magnet; and magnetizing the at least one external magnet of the external component to a selected magnetic strength in a clinical setting, wherein the selected magnetic strength optimizes, for the recipient, a transcutaneous retention force between the at least one external magnet and the implantable magnet, wherein the selected magnetic strength is dependent on a characteristic of the recipient.

15. The method of claim 14, comprising measuring a magnetic flux produced by the implantable magnet, and determining the selected magnetic strength based, in part, on the measured magnetic flux.

16. The method of claim 15, comprising measuring the magnetic flux with a sensor placed next to skin of the recipient adjacent the implantable component.

17. The method of claim 14, wherein magnetizing the at least one magnetic component changes a net magnetic flux produced by the external component.

18. The method of claim 14, further comprising:

positioning the external component, with the at least one external magnet encased therein, adjacent a magnetizing coil, and magnetizing the at least one magnet in situ within the external component.

19. The method of claim 18, wherein the at least one magnet is magnetized while housed within a closed case of the external component.

* * * * *